US006417763B1

(12) United States Patent
Petruzzi

(10) Patent No.: US 6,417,763 B1
(45) Date of Patent: Jul. 9, 2002

(54) MACHINE FOR AUTOMATED GENERATION OF MOVEMENT OF CHIMES

(76) Inventor: James D. Petruzzi, 520 Post Oak Blvd., Suite 270, Houston, TX (US) 77027

( * ) Notice: Subject to any disclaimer, the term of this patent is extended or adjusted under 35 U.S.C. 154(b) by 0 days.

(21) Appl. No.: 09/528,769

(22) Filed: Mar. 17, 2000

(51) Int. Cl.[7] ..... G08B 3/00

(52) U.S. Cl. ..... 340/392.1; 340/392.4; 116/141

(58) Field of Search ..... 340/392.1, 392.2, 340/392.4, 392.5, 395.1; 84/406, 402, 600; 116/141; 417/334; 446/217

(56) References Cited

U.S. PATENT DOCUMENTS 4,002,293 A * 1/1977 Simmons ..... 239/11
5,072,208 A * 12/1991 Christensen ..... 340/392.4
5,587,697 A * 12/1996 Rent ..... 340/392.4
5,744,736 A * 4/1998 Chang ..... 84/402
5,831,516 A * 11/1998 Jennings ..... 340/392.4
5,959,527 A * 9/1999 Beder et al. ..... 340/392.4
6,166,310 A * 12/2000 Carter ..... 84/402

* cited by examiner

*Primary Examiner*—Edward Lefkowitz
*Assistant Examiner*—Davetta W. Goins

(57) ABSTRACT

A machine for automated generation of movement of chimes with a base, an power source in the base electromagnetically connected to a post, chimes disposed about the post for receiving electromagnetic energy, a control circuit for generating intermittent electric power to said source for creating magnetic forces on said chimes. The chimes may also be moved by electric power, water movement, wind generated by the power source or ionic wind movement.

4 Claims, 4 Drawing Sheets

MACHINE FOR AUTOMATED GENERATION OF MOVEMENT OF CHIMES

BACKGROUND OF THE INVENTION

This invention relates generally to the field of wind chimes, and more particularly to a machine for automated generation of movement of chimes.

The generation of pleasing sounds has long fascinated mankind. From early days of percussion and wind instruments made from wood and animal hides, to more sophisticated instruments of metal and electronics, chimes have been made for many years to catch wind and produce a pleasing sound. Typically, a chime is a series of metal or ceramic pieces that hit each other or a striker in response to natural wind.

Chimes that operate on wind cannot work indoors having relatively low air movement. With so many people living in apartments or other confined spaces that cannot open windows, a chime that operates on a self-motivated principle is desired.

SUMMARY OF THE INVENTION

A primary advantage of the invention is to provide a wind chime emulator for indoor use.

Another advantage of the invention is to provide a wind chime that operates by generated wind.

Another advantage of the invention is to provide a wind chime that operates by magnetic inducement.

A further advantage of the invention is to provide a wind chime that operates by moving water.

Yet another advantage is to provide a wind chime that works from wind generated by solid state electronic ion flow.

In accordance with a preferred embodiment of the invention a machine for automated generation of movement of chimes comprises a base, a power source in said base electro-magnetically connected to a post, chimes disposed about the post for receiving electromagnetic energy and a control circuit for generating intermittent electric power to said source for creating magnetic forces on said chimes to create movement of the chimes.

In accordance with another preferred embodiment of the invention a machine for automated generation of movement of chimes comprises a base having a motor for generating intermittent power, a wind generator powered by the motor, chimes disposed in proximity to the wind generator that move in response to the wind.

In accordance with another preferred embodiment of the invention a machine for automated generation of movement of chimes comprises a base, a motorized pump in the base for pumping liquid, a wind generator responsive to movement of the liquid and chimes that respond to the wind generation.

In accordance with another preferred embodiment of the invention a machine for automated generation of movement of chimes comprises a base, a power source in the base and chimes that move in response to power generated by the power source.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
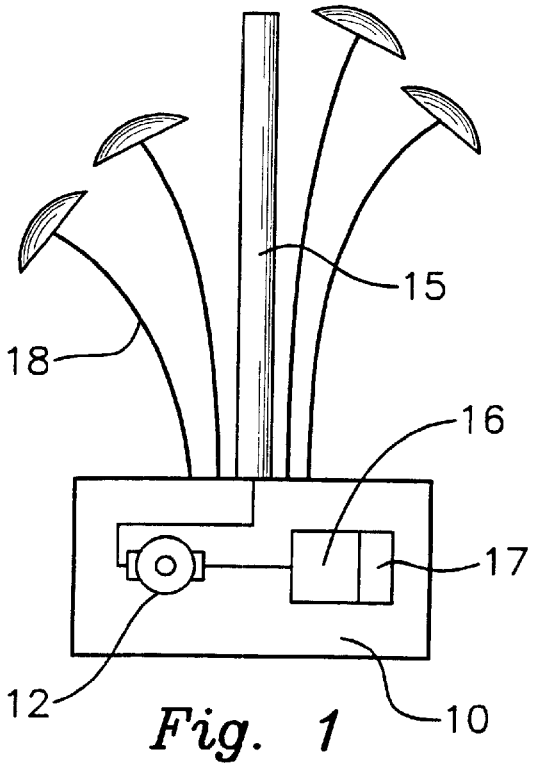
FIG. 1 is a perspective view of the invention showing a magnetically motivated wind chime.

Turning first to FIG. 1., there is shown a perspective view of the invention utilizing a magnetically powered wind chime. Base 10 houses an electrically powered motor 12 that is electrically connected to post 15 that may be battery operated or operated from an electrical outlet, or a combination. Post 15 receives electrical energy from power source 12 thereby creating a magnetic field about post 15. Suspended in proximity to post 15 are a plurality of chimes 18 that may be made of any suitable material, such as a metallic material, for creating sound upon striking the post 15. In another embodiment, the chimes may be in proximity to other objects to induce the chimes to strike those objects rather than the post itself. In either embodiment, the chimes are motivated to move at various times upon excitation of the post from the electrical energy created by the power source 12. The power source 12 is controlled by a control circuit 16 that induces electrical power to the post at predetermined times or randomly depending upon the desired sound. A random generator 17 in circuit 16 is capable of causing the power source to operate at different times to create the kind of random sounds a wind chime might make in response to actual natural wind. The control circuit 16 may also be programmed to create movement on the chimes on a predetermined frequency or timetable or any other programmed order.

Figure 2:
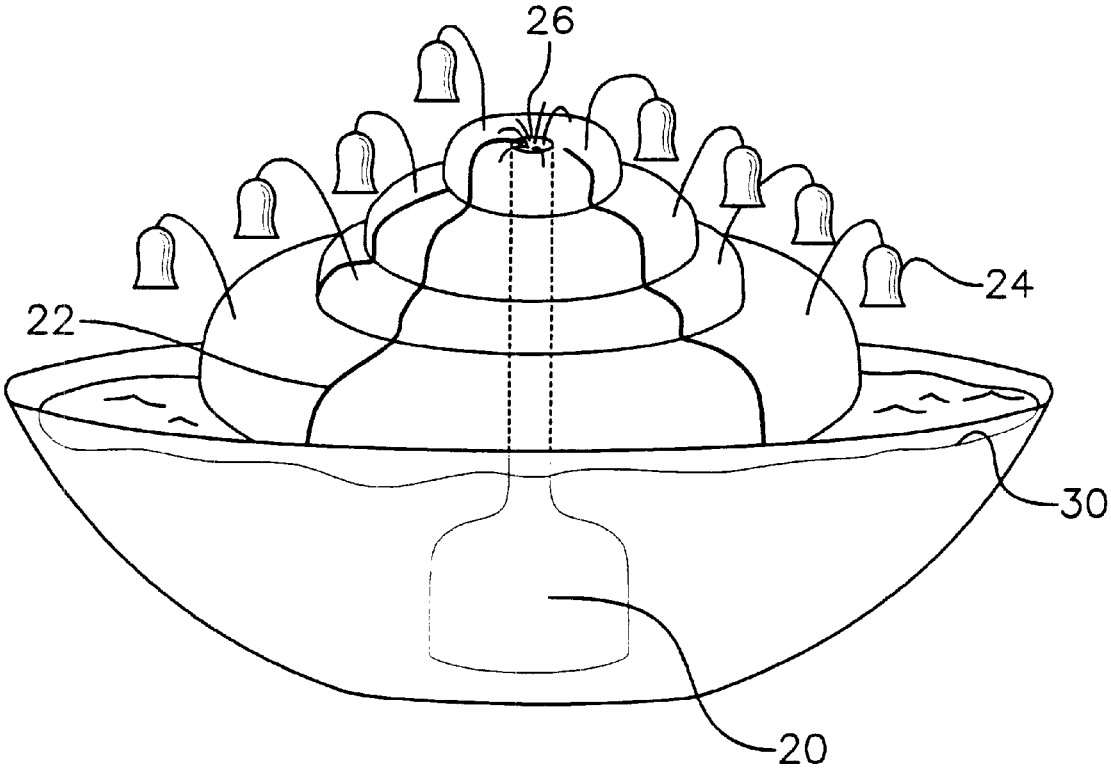
FIG. 2 is a perspective view of the invention showing a water driven wind chime.

Turning now to FIG. 2, there is shown another embodiment where the wind chimes are motivated by the movement of water about the chimes. Bowl 30 contains water that is continuously pumped by pump 20 through shaft 21 and out the aperture at the top of shaft 21. As the water flows downward about the plurality of tiers 25 through channels 22, it intermittently passes the wind chimes 24 and causes them to move. This movement is varied by the design of the channels to create a changing movement of the water to excite the chimes at differing intervals. "The exited chimes emit noise by engaging each other or another body such as tiers 25." The channels may be designed so that the water only flows down a particular channel at greatly extended time periods to create a wind like effect of intermittent breezes.

Figure 3:
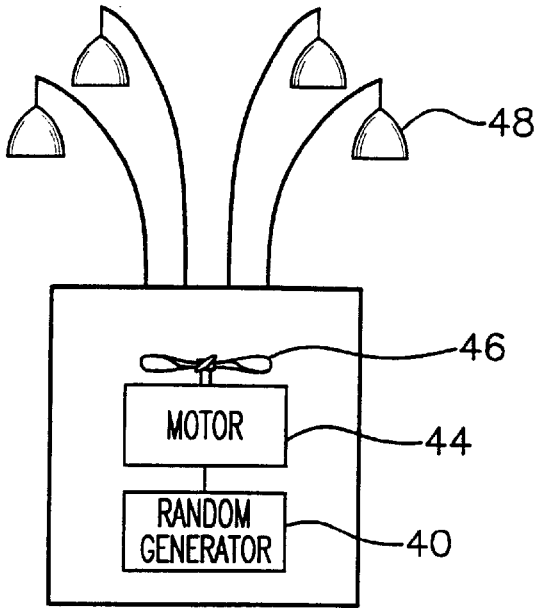
FIG. 3 is a perspective view of the invention showing a wind generator.

FIG. 3 shows yet another embodiment of the invention where a random generator 40 is housed in base unit 42. The random generator is electrically connected to a motor 44 that may be driven by battery or other electrical means not shown. The random generator excites the motor, which in turn drives fan 46 that is placed under a grate below a plurality of chimes 48. As the fan turns it generates a small wind that in turn causes the chimes to move and make sounds. The random nature of the motor is designed to achieve a realistic wind generation and not have the chimes constantly sounding. Alternatively, there may be some situations that require more constant chiming and it would be well known in the art to create a motor that activated the fan in a more recurrent fashion or continuously. Alternatively, constant wind may be generated through fan 46 that is driven through a series of one or more grates, each with apertures at irregular intervals that may also rotate at different speeds on in different direction to create the effect of random wind moving the chimes.

Figure 4:
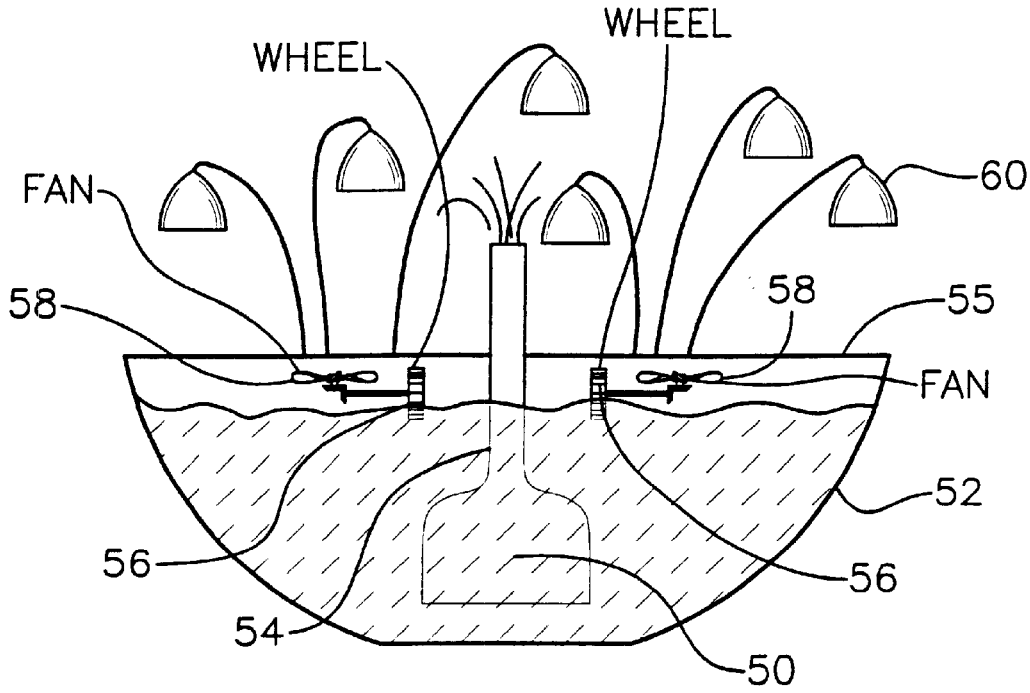
FIG. 4 is a perspective view of the invention showing a wind generated system where liquid movement creates the wind.
Figure 4A:
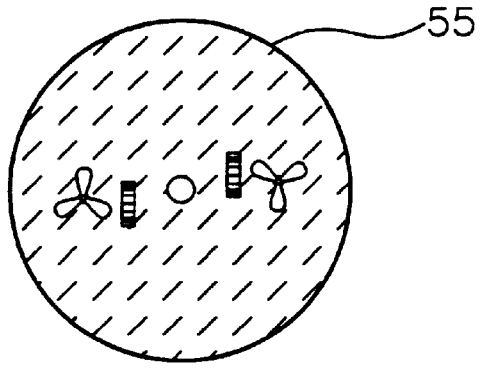

Turning now to FIG. 4, there is shown another embodiment whereby the wind chimes are excited by a wind generator that is powered by the movement of water across wheels. Pump 50 is displaced in water within vessel 52. As the water is pumped through shaft 54 it is pushed out of the top of the shaft and down the sides of the shaft and about the top surface of grate 55. Grate 55 is shown in plan view in FIG. 4A. As the water moves down and on top of the grate it goes through the grate and impacts wheels 56 which in turn drive fans 58. The grate is designed to permit only water to hit the wheels at intermittent times and only with enough force to drive the fan intermittently. As the fans 58 turn with sufficient force, a wind is created that excites the chimes 60 and causes sounds to be made. Numerous combinations of how the chimes are located, the degree and location that the water can traverse the grate, and the location of the fans and their ability to be driven can be altered and changed to create the desired sounds and frequency of sound generation.

Figure 5:
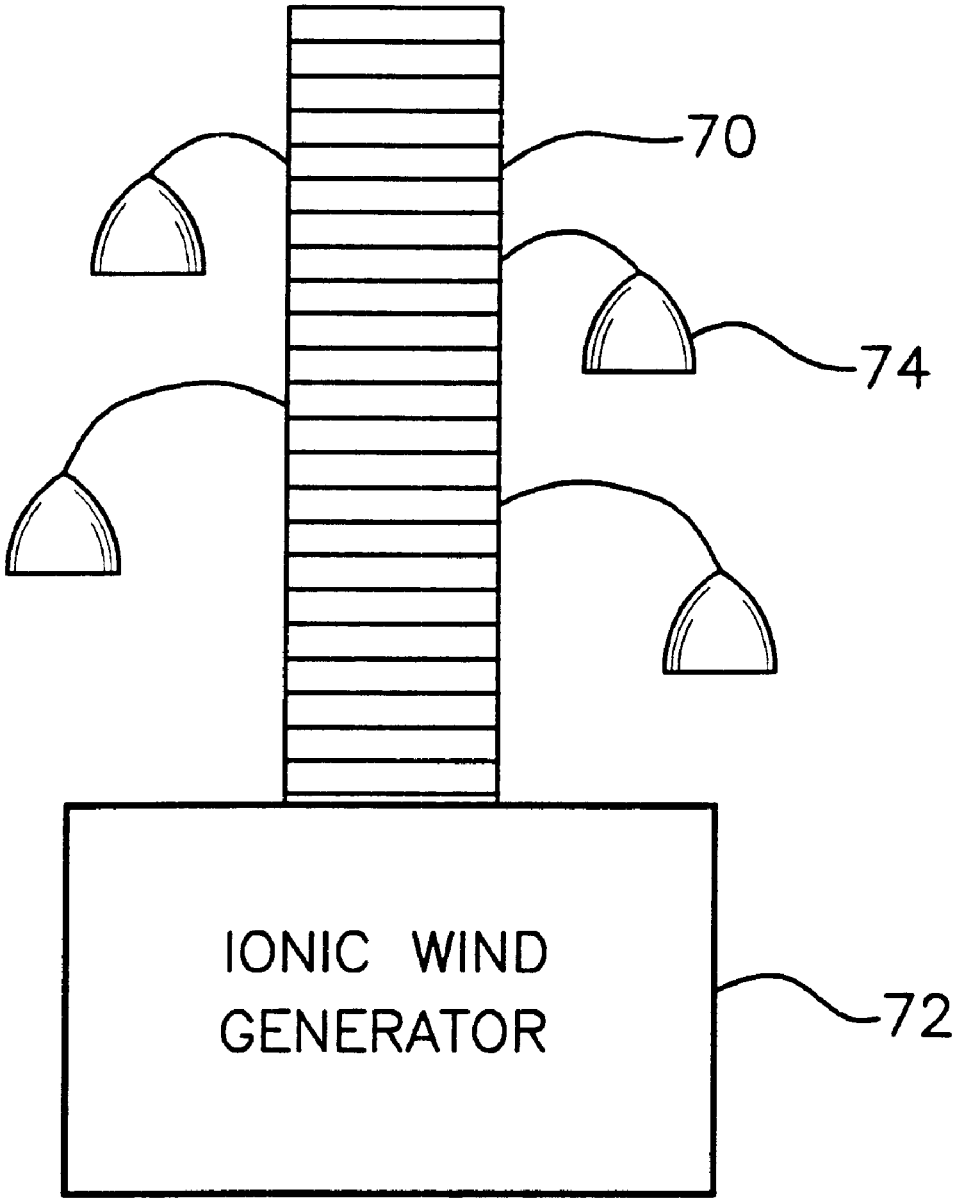
FIG. 5 is a perspective view of the invention showing an ionic wind flow generator.

FIG. 5 shows another embodiment whereby the movement of the chimes is created by wind that is caused by an ionic wind generator. It is well known in the art that a corona discharge occurs from a discharge electrode such as a needle electrode to a counter electrode such as a plate electrode when a high energy voltage is applied between the discharge and counter electrodes and that an ionic wind is then generated. A typical ionic wind has a velocity of several meters per second, and the force of the wind can be increased or deceased according to the required application of the wind generator. An ionic wind generator is contained in column 70, which is electrically connected to electronics in the base 72 for activating the ionic generator. As the ionic generator creates movement of air, the chimes 74 are excited and caused to strike each other or a third object such as column 70. This causes sound to be created by the chimes. Since the ionic generator is electrically controlled, it can be modulated with a random generator to create the sensation of intermittent wind.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A machine for automated generation of movement of chimes comprising:

a base;

a power source in said base electromagnetically connected to a post;

magnetically responsive chimes disposed about the post for receiving electromagnetic energy;

a control circuit for generating intermittent electric power to said source for creating magnetic forces on said chimes thereby causing said chimes to emit sound by contacting said post or each other.

2. A machine for automated generation of movement of chimes comprising:

a base having a motor for generating intermittent power;

a wind generator powered by said motor;

chimes disposed in proximity to said wind generator that move in response to the wind thereby creating a sound.

3. A machine for automated generation of movement of chimes comprising:

a base;

a motorized pump in said base for pumping liquid;

a wind generator responsive to movement of said liquid;

chimes that respond to said wind thereby creating a sound.

4. A machine for automated generation of movement of chimes comprising:

a base;

an power source in said base for generation of ionic wind;

chimes disposed in proximity to said wind;

a control circuit for creating intermittent generation of wind thereby causing said chimes to emit sound.

* * * * *